US007159339B2

(12) United States Patent
Mathieu et al.

(10) Patent No.: US 7,159,339 B2
(45) Date of Patent: Jan. 9, 2007

(54) BOTTOM ASSEMBLY FOR AN ARTICLE OF FOOTWEAR

(75) Inventors: Guillaume Mathieu, Les Cotes d'Arey (FR); Jean-Michel Challe, Rumilly (FR)

(73) Assignee: Salomon S.A., Metz-Tessy (FR)

( * ) Notice: Subject to any disclaimer, the term of this patent is extended or adjusted under 35 U.S.C. 154(b) by 156 days.

(21) Appl. No.: 10/773,284

(22) Filed: Feb. 9, 2004

(65) Prior Publication Data

US 2004/0168350 A1 Sep. 2, 2004

(30) Foreign Application Priority Data

Feb. 14, 2003 (FR) ..... 03 01899

(51) Int. Cl.
*A43B 7/06* (2006.01)
*A43B 13/12* (2006.01)
*A43B 13/14* (2006.01)
*A43B 21/00* (2006.01)

(52) U.S. Cl. ..... 36/30 R; 36/31; 36/82; 36/38; 36/3 B

(58) Field of Classification Search ..... 36/85, 36/87, 88, 92, 107, 30 R, 31, 82, 38, 29, 36/72 R, 3 B, 75 R
See application file for complete search history.

(56) References Cited

U.S. PATENT DOCUMENTS 4,259,792 A * 4/1981 Halberstadt ..... 36/30 R
4,322,895 A 4/1982 Hockerson
4,342,158 A 8/1982 McMahon et al.
4,372,058 A 2/1983 Stubblefield
4,494,321 A * 1/1985 Lawlor ..... 36/29
4,741,114 A * 5/1988 Stubblefield ..... 36/30 R
4,918,838 A * 4/1990 Chang ..... 36/29
5,224,280 A 7/1993 Preman et al.
5,299,368 A * 4/1994 Liu ..... 36/3 B
5,675,914 A * 10/1997 Cintron ..... 36/3 B
5,787,609 A * 8/1998 Wu ..... 36/29
5,975,861 A * 11/1999 Shin et al. ..... 36/29
6,470,599 B1 * 10/2002 Chu ..... 36/75 R
6,925,732 B1 * 8/2005 Clarke ..... 36/31

FOREIGN PATENT DOCUMENTS

DE 10107824 1/2003

* cited by examiner

*Primary Examiner*—Anthony Stashick
(74) *Attorney, Agent, or Firm*—Greenblum & Bernstein, P.L.C.

(57) ABSTRACT

An article of footwear having an upper and an outer bottom assembly, the outer bottom assembly having an outsole and, in the heel zone, an elastically deformable element that is substantially arch-shaped in the transverse direction and extends downward from the lower end of the upper to the medial, lateral edges, respectively, of the outsole.

28 Claims, 10 Drawing Sheets

BOTTOM ASSEMBLY FOR AN ARTICLE OF FOOTWEAR

CROSS-REFERENCE TO RELATED APPLICATION

This application is based upon French Patent Application No. 03.01899, filed Feb. 14, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to an article of footwear, i.e., a boot or shoe, for example, that is adapted for use for walking or running, particularly over mountainous terrain. More particularly, the invention relates to a sole or bottom assembly designed for such an article of footwear.

2. Description of Background and Relevant Information

FIGS. 1–4 illustrates problems related to the use of conventional shoes for running, especially in the mountains or uneven terrain.

Initially, running shoes are generally designed with shock-absorbing means, particularly in the heel area, for absorbing the repeated impacts that are generated during the stride, or in other areas the shoe that receive the most severe impacts, so as to avoid micro-traumatisms on the user's joints.

Typically, as shown in FIG. 1, such a shoe 10 has an upper 11 mounted on a bottom assembly 12, which bottom assembly has a midsole 13 made of a shock-absorbing material and a walking sole 14. The bottom assembly 12, seen in transverse cross-section, is substantially trapezoidal, with an acutely shaped, or sharp, edge 15. As a result, during lateral or medial bending of the foot or of the leg, the midsole 13 partially absorbs the additional forces by being compressed.

Once this midsole 13 is completely compressed, the shoe tends to tilt suddenly in relation to its edge 15 and can then cause injuries (sprains, etc.).

FIG. 2 shows another type of known shoe 10 which, like the shoe of FIG. 1, has an upper 11, a bottom assembly 12 having a shock-absorbing midsole 13, and a walking sole 14.

In this second type of shoe, described in U.S. Pat. No. 4,322,895, the object is to avoid the aforementioned shoe tilting problems by having the midsole rise along the upper. However, this second type of shoe has the same drawback of sudden tilting once the layer of the midsole 13 is completely compressed.

Furthermore, running shoes are generally designed to cooperate with flat terrain on which running events generally take place. However, the development of sporting contests of the "raid" type, including various sporting activities taking place in a mountainous environment, and including foot races in the mountains, in particular, involve new constraints on the shoes and the users. Indeed, foot races in the mountains generally take place on hilly, sloping, non-"planar" surfaces, i.e., those having numerous asperities, rocks, and which can even have slants, i.e., transverse slopes in relation to the main direction of the race.

Because only few running shoes actually provided for such conditions are commercially available, there are numerous traumatic problems and risks of accidents for the runners.

FIGS. 3 and 4 show the behavior of the conventional shoes shown in FIGS. 1 and 2 on sloping terrains, and particularly on slanting terrain, i.e., having a slope in the transverse direction in relation to the main direction of the race.

In each of these cases, the bottom assembly 12, 22, respectively, of each shoe 10, 20, respectively, deforms slightly depending upon the slope of the terrain, but insufficiently, such that the vertical median plane T of the upper remains very inclined with respect to the vertical plane V, i.e., with respect to a plane perpendicular to the horizontal, and that the shoe tends to slide in a direction G along the slope.

At the end, the angle β, created by the median vertical plane T of the upper relative to the vertical plane V, corresponds to the slant angle of the slope.

SUMMARY OF THE INVENTION

An object of the present invention is to overcome the aforementioned drawbacks, and to provide an article of footwear, particularly a running shoe, having a bottom assembly adapted for making it possible to improve the grip of the shoe on a hilly, sloping, slanting terrain, and which also allows for a better adaptation to the unevenness and irregularities of the terrain.

Another object of the present invention is to provide a more stable shoe or article of footwear.

Finally, the article of footwear according to the invention includes shock-absorbing characteristics that are compatible with use in a foot race.

This object is achieved according to the invention, with an article of footwear that is of the type having an upper and an outer bottom assembly, the outer bottom assembly having an outsole (or wear sole or external sole) and, in the heel zone or forefoot zone, an elastically deformable element that is substantially arch-shaped in the transverse direction and that extends downward from the lower end of the upper to the medial, lateral edge, respectively, of the outsole.

Indeed, the arch-shaped or vault-shaped elastically deformable element makes it possible to directly carry the forces imposed by the wearer over to the medial, lateral edge, respectively, of the outsole, and therefore to increase the gripping effect noticeably, compared to a shoe of the conventional type where the forces are uniformly transmitted, even on a sloping terrain.

Furthermore, the deforming ability of the elastically deformable element enables the bottom assembly to deform in a progressive and continuous manner, in the case of a medial or lateral bending, and prevents any risk of sudden tilting that could cause injuries (sprains, etc.).

According to one embodiment, the elastically deformable element has on each side at least one medial, lateral arm, respectively. The provision of independent lugs or arms further improves the adaptability of the elastically deformable element to the terrain and to the various roughness/unevenness thereof, and therefore makes it possible to guarantee an optimal stability of the entire shoe, irrespective of the type of terrain.

BRIEF DESCRIPTION OF DRAWINGS

The invention will be better understood and other characteristics thereof will become apparent from the description that follows, with reference to the annexed schematic drawings showing several embodiments by way of non-limiting examples, and in which.

DETAILED DESCRIPTION OF THE INVENTION

Figure 1:
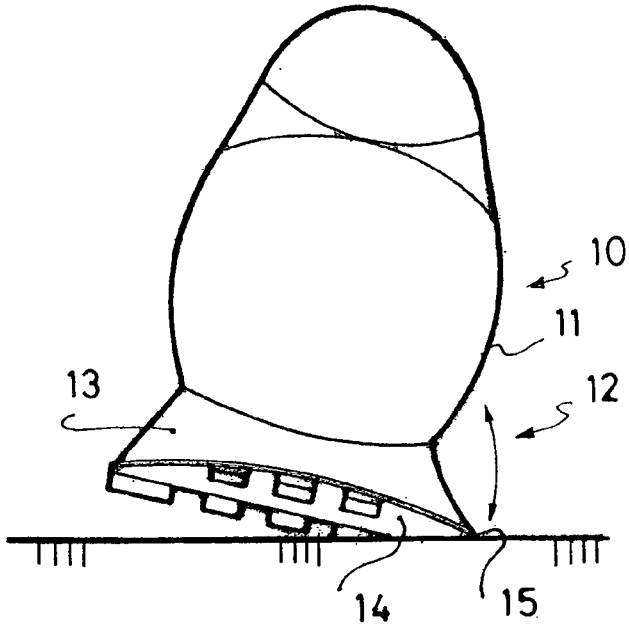
Fig. 1 Prior Art
FIGS. 1 and 2 are schematic views showing the behavior of shoes of known types in the case of a lateral bending.
Figure 2:
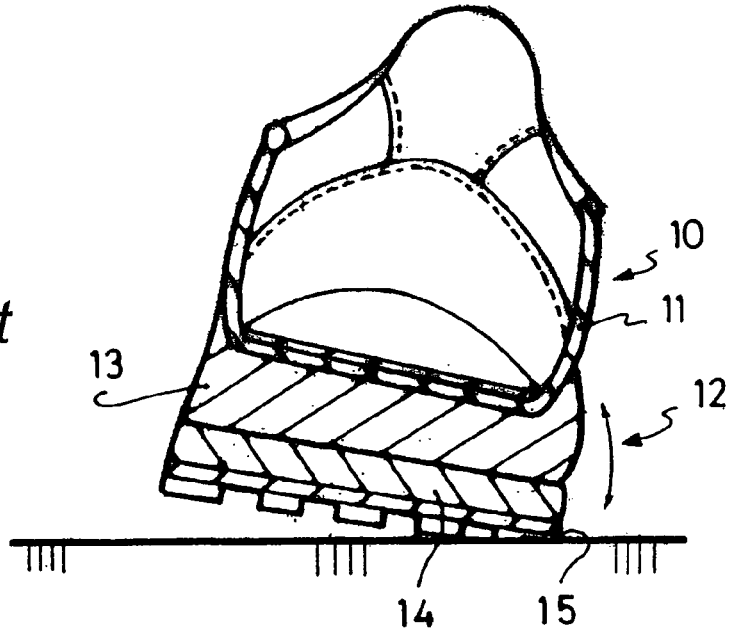
Fig. 2 Prior Art
Figure 3:
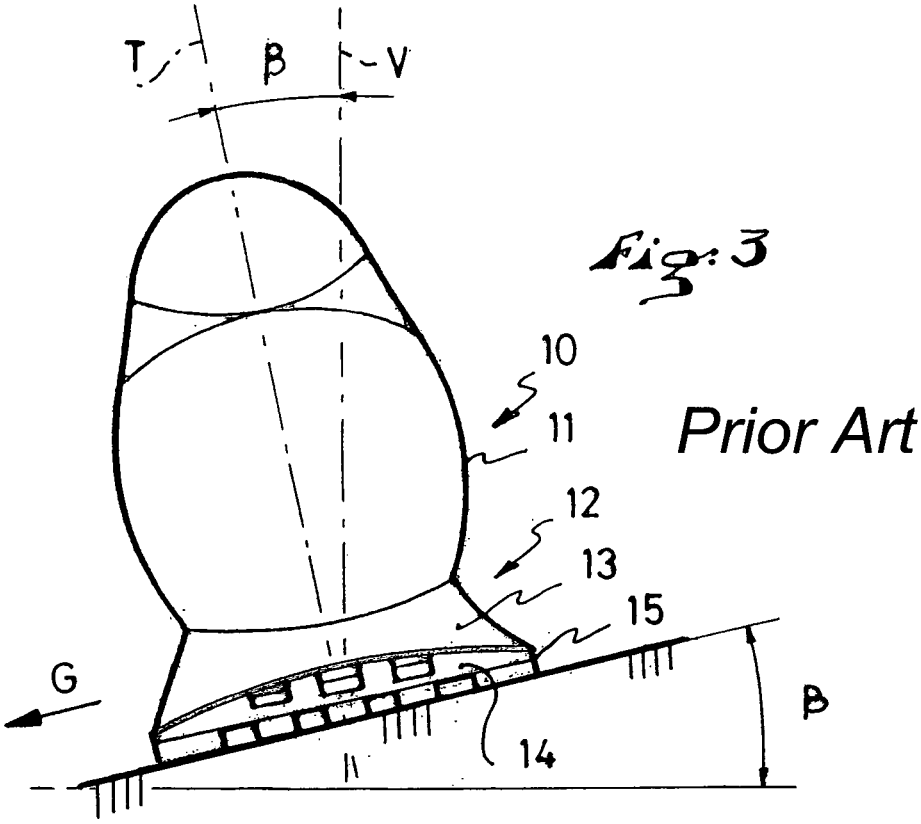
Fig: 3 Prior Art
FIGS. 3 and 4 are views, similar to FIGS. 1 and 2, showing the behavior of shoes of known types on a sloping terrain.
Figure 4:
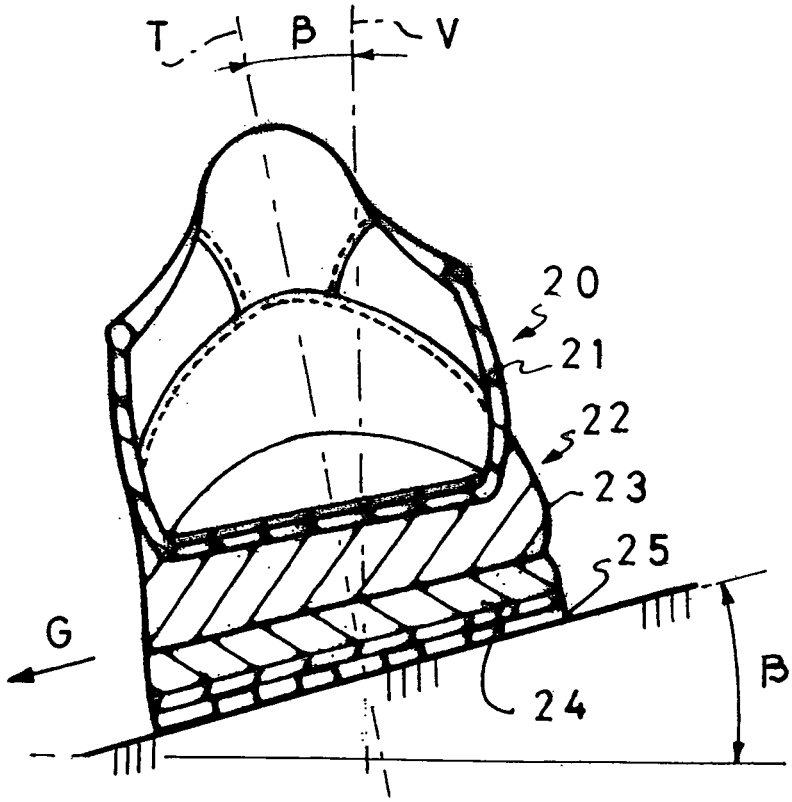
Fig: 4 Prior Art
Figure 5:
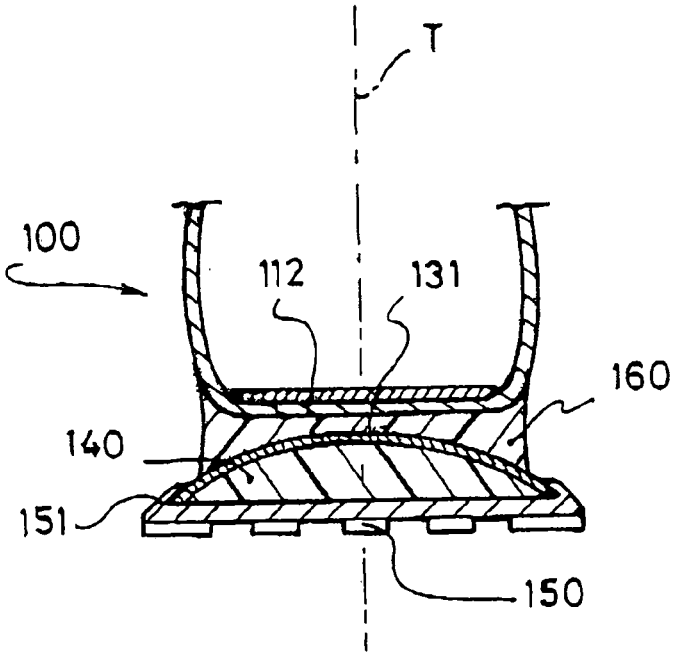
FIG. 5 is a transverse cross-sectional view of a first embodiment of the invention.
Figure 6:
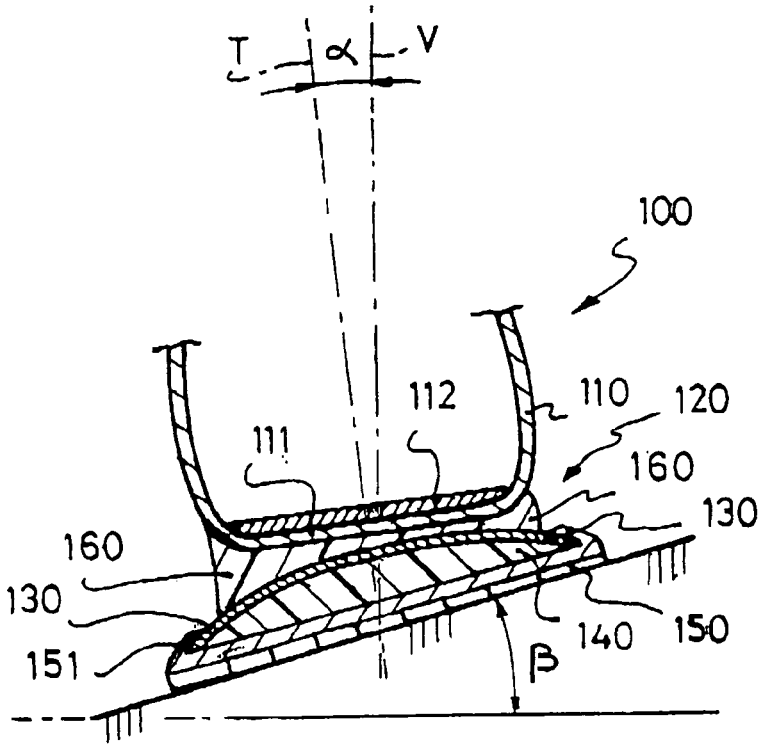
FIG. 6 is a view, similar to FIG. 5, showing the functioning of the shoe on a sloping terrain.

FIGS. 5 and 6 show, by means of a schematic transverse cross-section in the heel area, a first embodiment of a shoe 100 according to the invention. This shoe 100 has an upper 110 provided with an inner sole or insole 112, and a bottom assembly 120.

Although the term shoe is used herein for convenience, such use is not intended to limit the invention otherwise described herein, which invention is intended to encompass articles of footwear not specifically illustrated, such as those having uppers that extend above the ankle, for example, as well as those having uppers that rise to the level of the ankle or below the ankle.

The bottom assembly 120, from top down, includes the following:

- a wedge 160 for connecting to the upper 110;
- an elastically deformable element 130 that is substantially arch-shaped or vault-shaped in transverse cross-section;
- a layer of shock-absorbing material 140;
- an outsole or walking sole 150.

The elastically deformable element 130 is made of a relatively rigid but elastically deformable material having a Young's modulus E greater than 40 Mpa or greater than approximately 40 Mpa.

Materials from which element 130 can be constructed include:

- Polyurethane (PUR, TPU), reinforced or non-reinforced, with a Young's modulus E greater than 40 Mpa;
- Polyamide (PA), reinforced or non-reinforced;
- Polyethylene (PE) and, generally speaking, all of the synthetic materials
- having a Young's modulus E greater than 40 Mpa or greater than approximately 40 Mpa.

The "composite" materials having a Young's modulus E greater than 50 Mpa can also be envisioned according to the invention.

The thickness of the elastic element 130 is a function of the degree of elasticity desired and of the Young's modulus of the material selected.

In the example shown in FIGS. 5 and 6, the elastically deformable element 130 has the shape of a regular vault, with a part-circle portion extending from the lower end 111 of the upper 110 to the medial and lateral edges 151, respectively, of the outsole 150.

Due to its vault shape, a wedge 160, or intermediate member, is necessary to ensure the connection of the upper rounded end 131,or uppermost portion, of the elastically deformable element 130 to the lower end 111 of the upper. This wedge 160 has, in transverse cross-section, an upper edge 161, or an upper surface segment, that conforms to the outer shape, or an outer surface segment, of the upper 110, and a lower edge 162 that conforms to the outer shape of the elastically deformable element 130. Also shown in the embodiment of FIGS. 5 and 6, the elastically deformable element 130 extends transversely from a central area beneath the upper at least to a position vertically beneath the medial side of the upper and at least to a position vertically beneath the lateral side of the upper 110 and, in FIGS. 5 and 6, therebeyond and, further, beyond both the lateral and medial extents of the insole 112 of the shoe 100, at least in the heel area thereof, that is, the element 130 is wider than the insole 112.

The wedge 160 can be made of a material such as EVA, TPU foam, or of a compound material having a hardness between 20 Asker C and 200 Asker C, so as to procure an additional shock-absorbing effect, and therefore more comfort in the heel area. It can also be made of another material, such as PU, PA, not necessarily having shockabsorbing properties.

The assembly of the upper 110, wedge 160, and elastic element 130 is carried out in a known manner by means of glues/adhesives conventionally used for assembling soles.

The layer of shock-absorbing material 140, like the wedge 160, is made of EVA, TPU foam, or of a compound having a hardness between 20 and 200 Asker C.

The layer 140 is entirely confined between the elastic element 130 and the outsole 150. According to the embodiment shown in these figures, the edges 151 of the outsole 150 rise slightly on the elastic element 130.

As can be easily understood, and as shown by comparing FIGS. 5 and 6, the elastically deformable element, or elastic element 130, makes it possible to transfer the forces, applied centrally by the wearer's foot at the top of the arch, to the edges 151 of the outer sole 150. As a result, the gripping effect of the bottom assembly on the terrain is considerably increased, even on a hilly terrain having a slanting slope. Furthermore, this transmission of forces is accompanied by an elastic deformation of the elastic element 130 that allows straightening the vertical median plane T of the upper 110, and bringing it as close as possible to the vertical plane V, the angle $\alpha$ therefore being less than the angle $\beta$.

This straightening of the upper 110 also makes it possible to guarantee a good foot stability. Furthermore, due to its force, the elastic element 130 can deform in a progressive and continuous manner by becoming flat, and the risks of tilting generated in shoes of known types are avoided.

Finally, this ability of the bottom assembly to deform progressively enables the user to have a good proprioception, and constitutes an additional guarantee for limiting risks of injuries.

The additional layer of shock-absorbing material 140 makes it possible to have an additional and therefore more efficient shock absorption in the area of the sole. In other words, for the same shock-absorption efficiency, it is possible to reduce the overall height of the bottom assembly and therefore to further increase the stability of the shoe.

Depending upon the type of shock-absorption or use desired for the shoe, it is quite possible to eliminate the additional shock-absorbing layer 140.

FIGS. 7, 8, 9, 10 show a second embodiment of the invention in which the same elements are designated by the same reference numerals.

Figure 7:
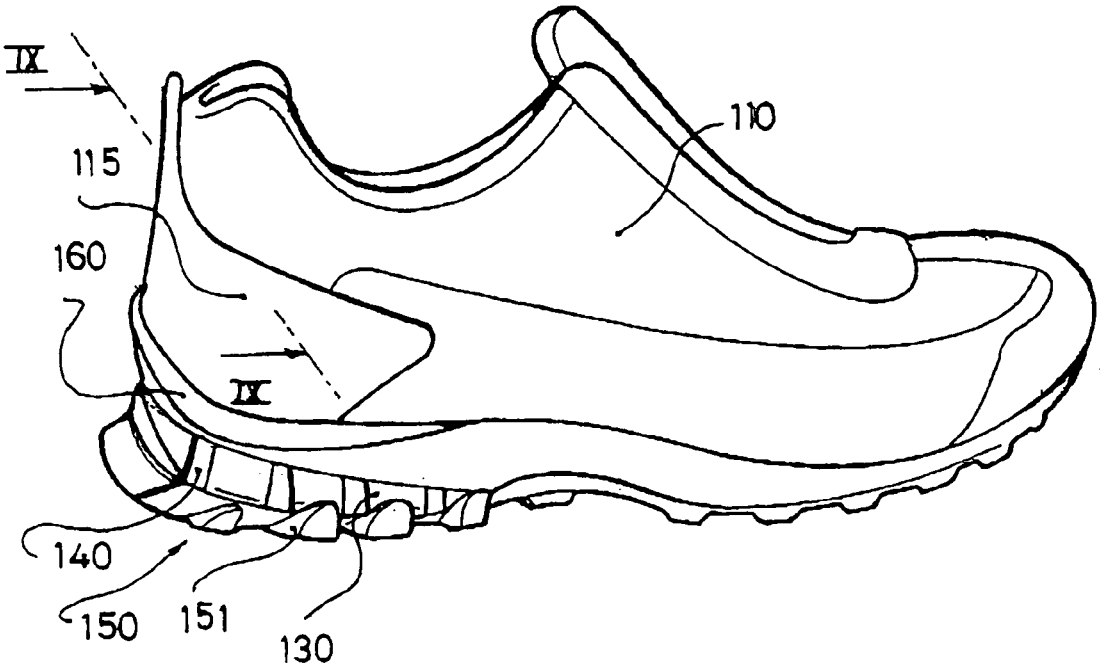
FIG. 7 is a rear perspective view of a shoe according to a second embodiment.
Figure 8:
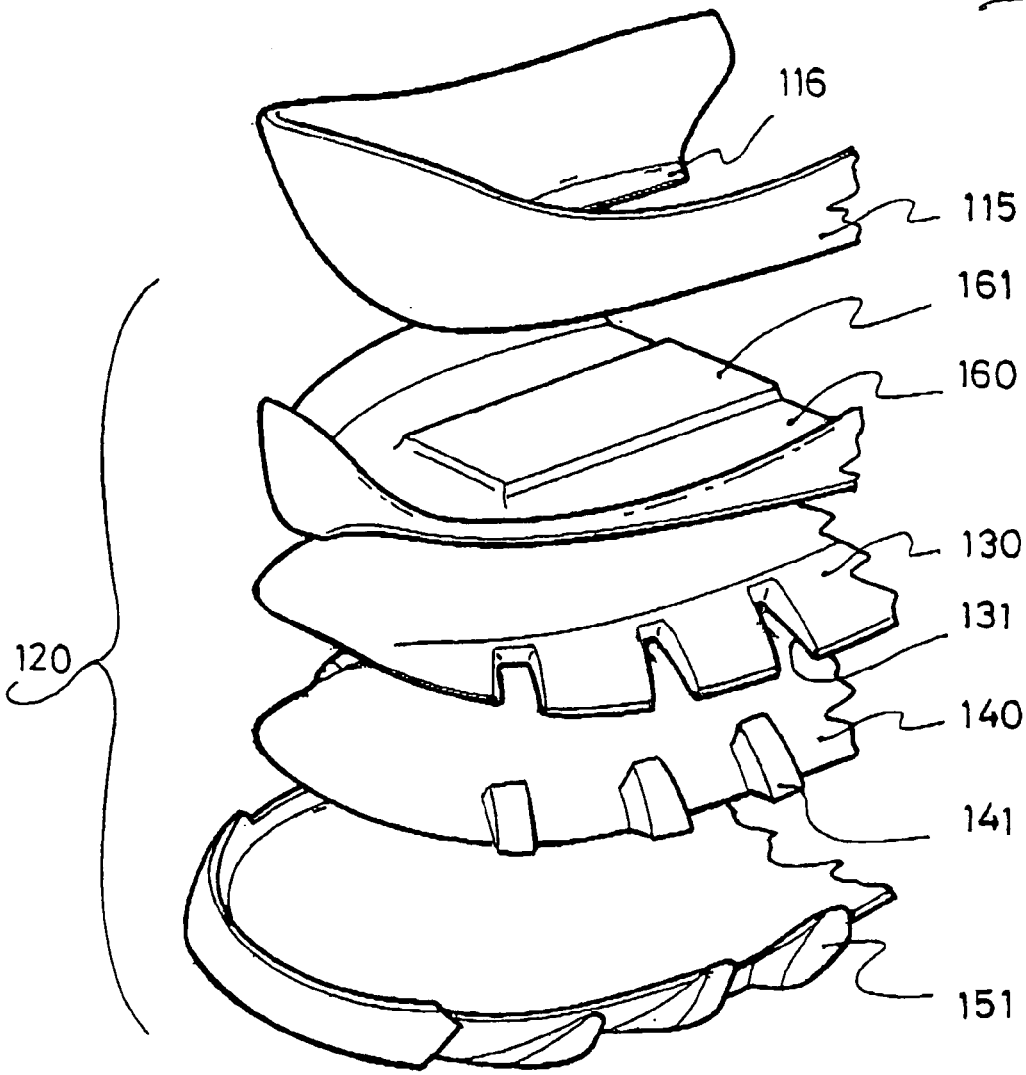
FIG. 8 is an exploded rear perspective view of the heel portion of the shoe of FIG. 7.
Figure 9:
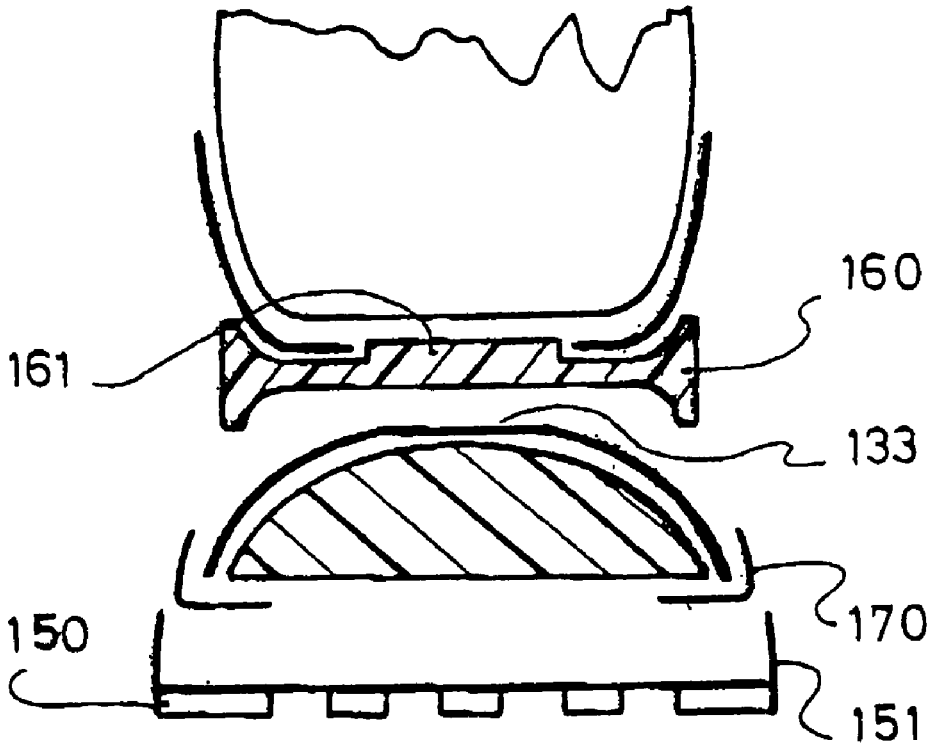
FIG. 9 is a schematic cross-sectional view along the line IX—IX of FIG. 7.
Figure 10:
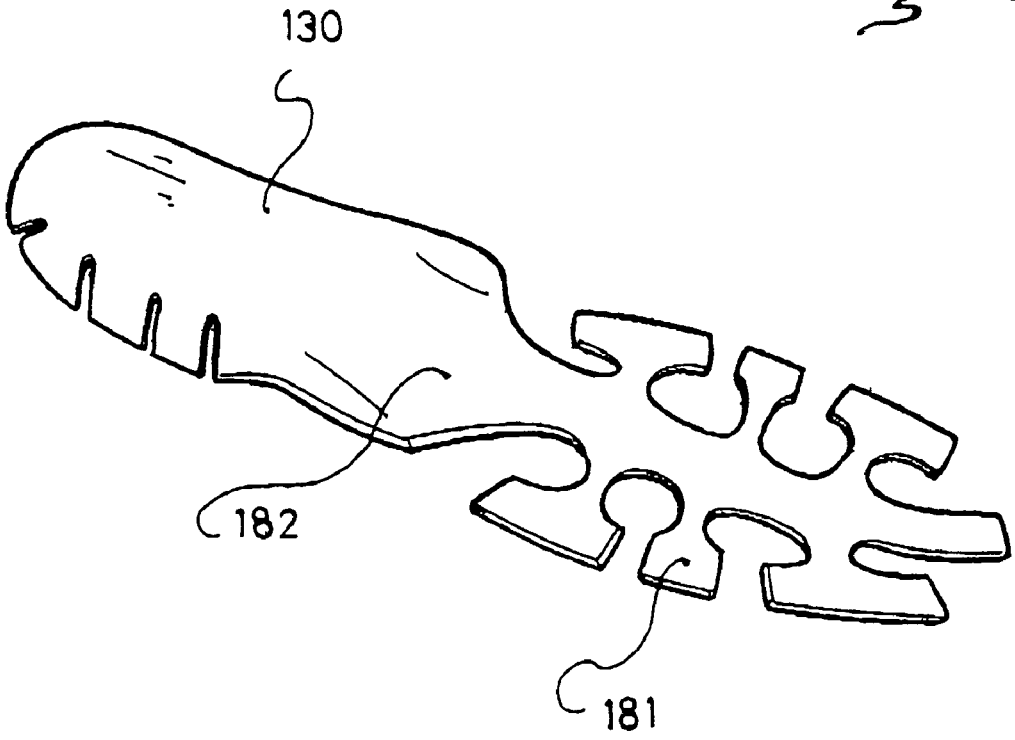
FIG. 10 is a perspective view of a bottom assembly element according to the invention.

FIGS. 7 and 9 particularly show the stacking of the various layers of the bottom assembly in the heel zone, namely:

outsole 150;

shock-absorbing material 140;

elastically deformable element 130;

connecting member or wedge 160.

Furthermore, in this embodiment, the upper 110 is provided with an outer heel stiffener 115 adapted to procure more stability to the foot and to better transmit the force of the foot to the ground via the elastically deformable element 130. This heel stiffener 115 is preferably made of a rigid synthetic or composite material, and is selected so as to have a Young's modulus E greater than 40 Mpa, or greater than approximately 40 Mpa. It is assembled to the upper 110 either at the time of positioning the bottom assembly 120, or prior to that. This stiffener 115 can be recessed as shown in FIG. 9, i.e., surrounding the periphery of the upper with an inward edge 116, or can be provided with a bottom (not shown) that is then inserted between the upper 110 and the bottom assembly 120.

Other materials can be provided for the stiffener.

In this embodiment, the elastic element 130 is provided with lateral slits 131 demarcating arms 132 extending from the top to the bottom, on the sides of the bottom assembly, and capable of becoming elastically deformed, independently of one another.

These arms 132 allow for a greater general elasticity of the elastic element 130, on the one hand, and for a better adaptation to the irregularities of the terrain due to their ability to deform independently of one another, on the other hand. In this case, the shock-absorbing element 140 has projections 141 adapted to engage in the slits 131 and to allow for a better nesting prior to the final assembly. The elastic element 130 also has an upper zone 133 that is flattened to facilitate its assembly to the upper 110. The connecting wedge 160 also has, at its upper portion, a projection 161 adapted to facilitate its nesting in the stiffener 115 of the upper (see FIG. 9 in particular).

The edges 151 of the walking sole are raised and partially cover the lower ends of the elastic element 130 and of its arms 132. If necessary, pieces of textile 170 can be provided between the elastic element 130 and the walking sole 150 to facilitate the gluing to the latter.

Finally, the elastic element 130 can be part of a sole reinforcement element 180 extending up to the front of the bottom assembly. In this case, the front portion 181 of the reinforcement 180 is planar and connects to the rear portion 130 by an inclined zone 182 in the area of the plantar arch zone.

In one embodiment, the front portion 181 of the reinforcement 180 is in direct contact with the walking sole so as to procure a better grip as described in the commonly owned U.S. Pat. No. 6,079,125.

FIGS. 11–14 show other embodiments for which the same reference numerals are also used to designate similar or identical elements.

Figure 11:
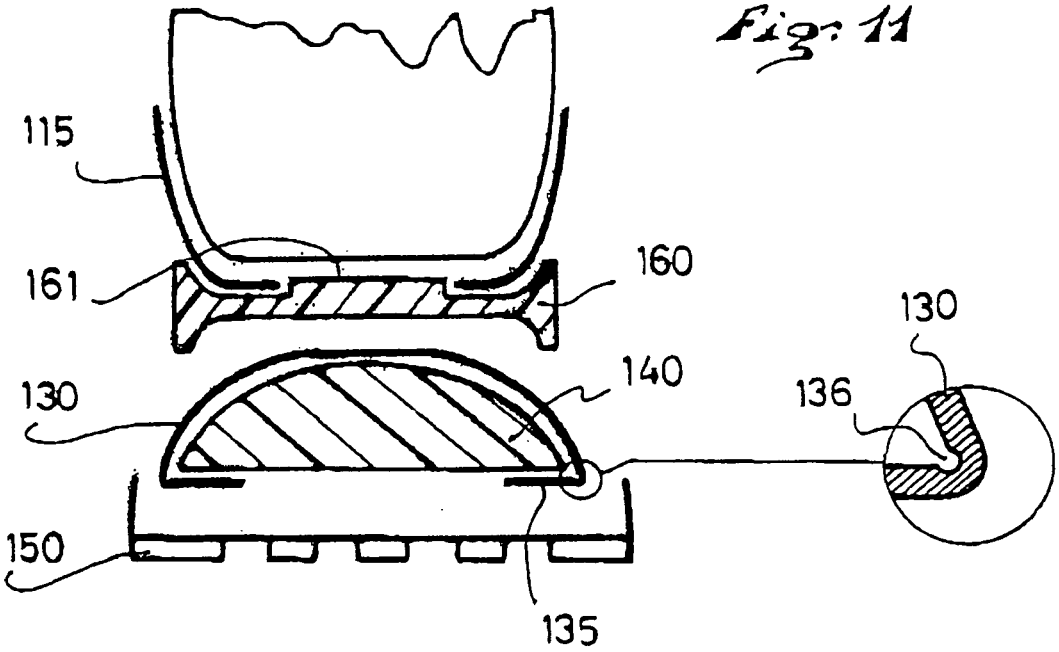
FIG. 11 is a schematic view, similar to FIG. 9, of a third embodiment.

In the example shown in FIG. 11, the elastic element 130 has, in its lower portion, returns 135 adapted to facilitate its gluing to the outsole 150. These returns 135 are preferably obtained by molding with the element 130, a hinge zone 136 making it possible to fold them back after the removal from the mold.

Figure 12:
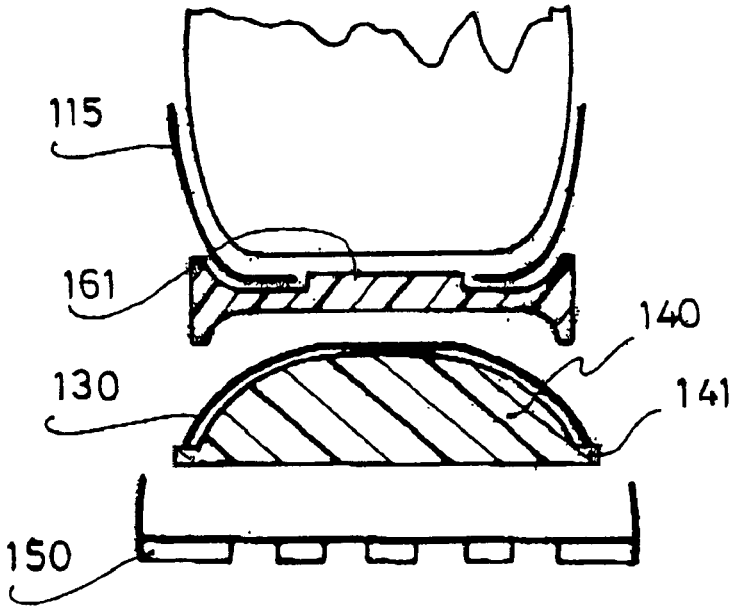
FIG. 12 is a schematic view, similar to FIG. 11, of a fourth embodiment.

In the example shown in FIG. 12, the shock-absorbing element 140 has a peripheral edge 141 adapted to receive the lower ends of the elastic element 130 and to facilitate the assembly of the bottom assembly 120.

Figure 13:
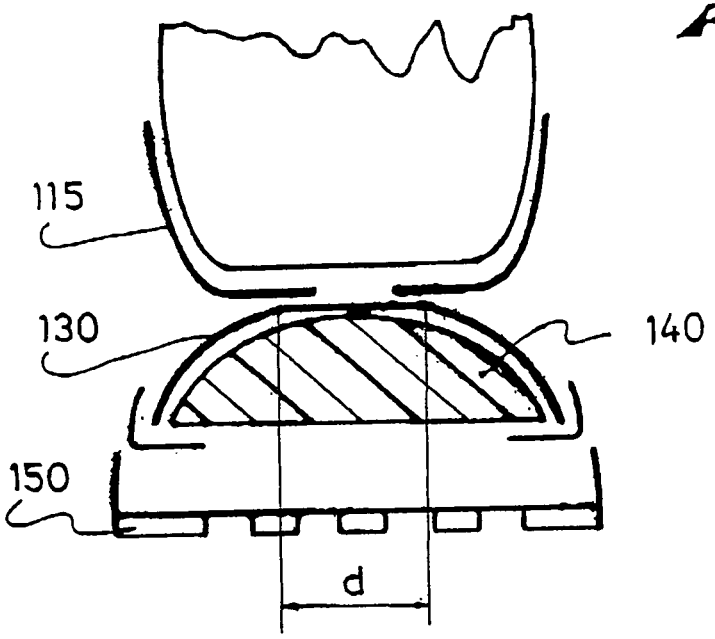
FIG. 13 is a schematic view, similar to FIG. 11, of a fifth embodiment.

The embodiment of FIG. 13 corresponds substantially to that of FIG. 9, the difference being the suppression of the connecting wedge 160. In this case, the upper planar zone 133 of the elastic element is larger to allow for a better gluing to the upper. As a general rule, this planar zone 133 has a width "d" between 15 and 20 millimeters (mm) in the transverse direction.

Figure 14:
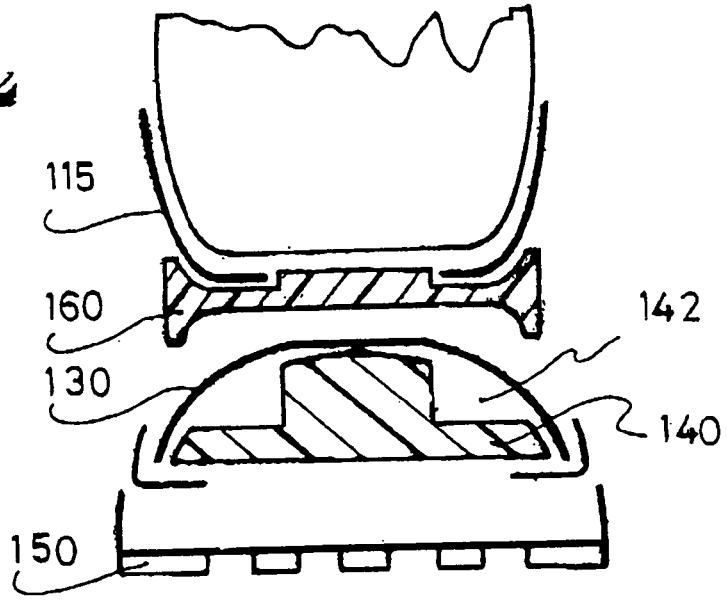
FIG. 14 is a schematic view, similar to FIG. 11, of a sixth embodiment.

Finally, in the embodiment of FIG. 14, the shock-absorbing element has recesses 142 to facilitate the deformation of the elastically deformable element 130.

These recesses 142 can have various forms; they can be stepped, asymmetrical, etc. A significant feature is that these recesses 142 facilitate the deformation of the elastically deformable element 130.

Figure 15:
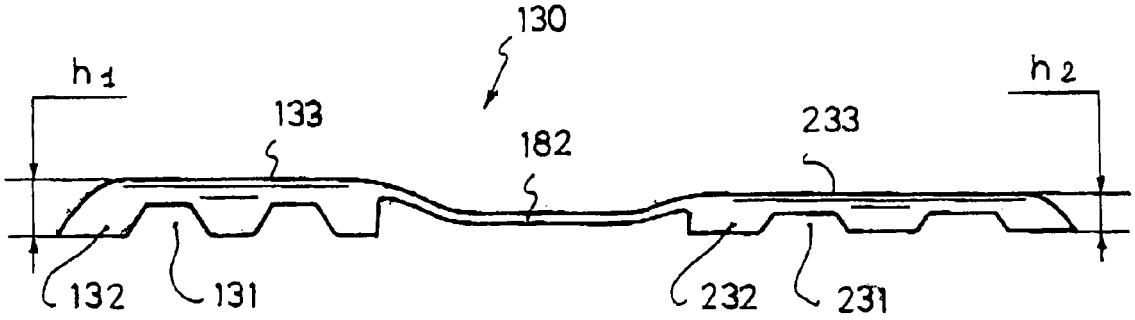
FIG. 15 is an elevated view of a bottom assembly element according to another embodiment.
Figure 16:
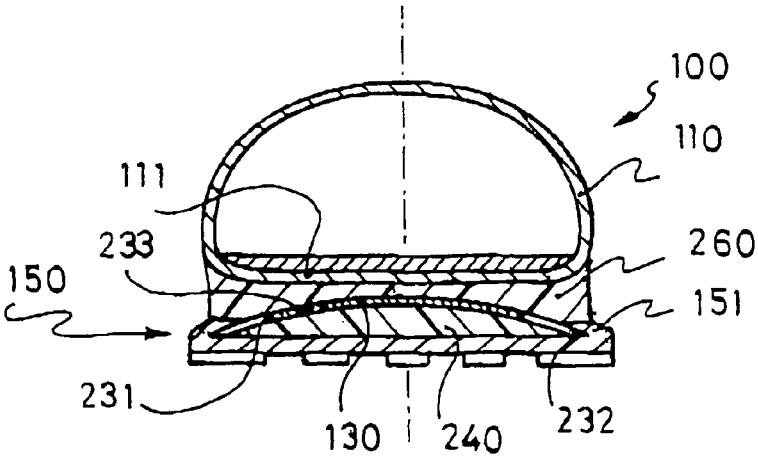
FIG. 16 is a transverse cross-sectional view of the bottom assembly according to another embodiment incorporating the bottom assembly element according to FIG. 15.

In the embodiment shown in FIGS. 15 and 16, the elastically deformable element 130 has the shape of a vault, not only at the rear in the heel zone, but also at the front in the forefoot zone.

With respect to the rear, similar or identical elements are designated by the same reference numerals.

At the rear, the elastically deformable element 130 therefore has a flattened upper zone 133 extending downward by means of arms 132 separated by slits 131.

As shown in FIG. 15, the flattened upper zone 133 has a given height hi that is a function of the degree of shock-absorption desired.

At the front, the elastically deformable element 130 has a more or less flattened upper zone 233 that extends downward by means of arms 232 separated by slits 231.

As shown in FIG. 15, the flattened upper zone 233 of the forefoot has a height h2 that is generally lower than the height h1. As mentioned previously, the height h2 is a function of the shock-absorption desired.

Depending on the effects desired (for example, leg muscle building) h2 can conversely be greater than h1.

A transitional zone 182 separates the two portions 133, 233 of the elastically deformable element 130.

FIG. 16 shows the incorporation of the portion 233 of the elastically deformable element 130 into the forefoot portion of a bottom assembly.

In this case, the elastically deformable element 130 also substantially has, in the forefoot zone, the transverse shape of an arch extending downward from the lower end 111 of the upper 110 to the medial and lateral edges, respectively, of the outsole 150.

FIG. 16 does show the stacking of the various layers of the bottom assembly in the forefoot zone, namely, from the bottom up:

outsole 150;

shock-absorbing material 240;

elastically deformable element 130, connecting member or wedge 260.

As described previously, the edges 151, in this embodiment, are raised and partially cover the lower ends of the elastic element 130 and of its arms 232.

The functioning is the same as described previously, i.e., the elastic element 130 makes it possible to transfer the forces, centrally applied by the user's foot at the top of the arch, to the edges of the outsole 150. As a result, the gripping effect of the bottom assembly on the terrain is considerably increased, both at the front and the rear of the shoe.

Depending upon the type of shoe and application, the aforementioned gripping effect can be provided at the front only, at the rear only, or in both areas at the same time.

The present invention is not limited to the particular embodiments described hereinabove by way of non-limiting examples, but encompasses all similar or equivalents embodiments.

What is claimed is:

1. An article of footwear comprising:

an upper;

an outer bottom assembly, the outer bottom assembly comprising:

an outsole;

an elastically deformable element, the elastically deformable element having a substantially arch shape in a transverse direction of the outer bottom assembly, the elastically deformable element having an uppermost portion beneath a lower end of the upper, the elastically deformable element having an upper surface extending downward from the uppermost portion to medial and lateral edges, respectively, of the outsole, said upper surface of the elastically deformable element not extending upwardly at the medial and lateral edges of the outsole;

the elastically deformable element being located in a heel zone and/or in a forefoot zone of the article of footwear; and a layer of shock-absorbing material positioned between the elastically deformable element and the outsole.

2. An article of footwear according to claim 1, wherein: the elastically deformable element comprises a material having a Young's modulus of at least 40 Mpa.

3. An article of footwear according to claim 2, wherein: the elastically deformable element includes an upper end with a substantially planar zone.

4. An article of footwear according to claim 3, wherein: the planar zone has a width of about 15–20 millimeters.

5. An article of footwear according to claim 1, wherein: the elastically deformable element comprises at least one medial arm and at least one lateral arm.

6. An article of footwear according to claim 1, wherein: the layer of shock-absorbing material comprises at least one recess between said layer and the elastically deformable element.

7. An article of footwear according to claim 1, wherein: the elastically deformable element is fixed to the upper via a connecting member/wedge.

8. An article of footwear according to claim 1, wherein: an outer stiffener is positioned between the upper of the shoe and the elastically deformable element.

9. An article of footwear according to claim 1, wherein: the elastically deformable element comprises polyurethane.

10. An article of footwear according to claim 1, wherein: the elastically deformable element comprises polyethylene.

11. An article of footwear according to claim 1, wherein: the elastically deformable element comprises a composite material having a Young's modulus of at least 50 Mpa.

12. An article of footwear according to claim 1, wherein: the elastically deformable element is located in the heel zone of the article of footwear.

13. An article of footwear according to claim 1, wherein: the elastically deformable element is located in the forefoot zone of the article of footwear.

14. An article of footwear according to claim 1, wherein: the elastically deformable element is located in the heel zone and in the forefoot zone of the article of footwear.

15. An article of footwear according to claim 14, wherein: in the forefoot zone of the article of footwear, the elastically deformable element has a height greater than a height of the elastically deformable element in the heel zone of the article of footwear.

16. An article of footwear according to claim 14, wherein: in the forefoot zone of the article of footwear, the elastically deformable element has a height less than a height of the elastically deformable element in the heel zone of the article of footwear.

17. An article of footwear according to claim 14, further comprising:

a sole reinforcement element;

the elastically deformable element comprising a rear part of the sole reinforcement element and a front part of the sole reinforcement element, the front part of the sole reinforcement element being planar.

18. An article of footwear according to claim 17, wherein: the front part of the sole reinforcement element is connected to the rear part of the sole reinforcement by means of a inclined zone in a plantar arch area.

19. An article of footwear according to claim 7, wherein: the connecting member/wedge comprises EVA.

20. An article of footwear according to claim 7, wherein: the connecting member/wedge comprises TPU.

21. An article of footwear according to claim 7, wherein: the connecting member/wedge comprises PU.

22. An article of footwear according to claim 7, wherein: the connecting member/wedge comprises PA.

23. An article of footwear comprising:

an upper having a medial side and a lateral side;

an outer bottom assembly, the outer bottom assembly comprising:

an outsole;

an elastically deformable element, the elastically deformable element having a substantially arch shape in a transverse direction of the outer bottom assembly, the elastically deformable element having an uppermost central portion beneath a lower end of the upper, the substantially arch shape of the elastically deformable element extending downward from the uppermost portion to medial and lateral edges, respectively, of the outsole:

the elastically deformable element having an upper surface extending from said uppermost central portion at least to a position vertically beneath the medial side of the upper and at least to a position vertically beneath the lateral side of the upper, said upper surface of the elastically deformable element not extending upwardly vertically beneath either of the medial and lateral sides of the upper;

the elastically deformable element being located in a heel zone and/or in a forefoot zone of the article of footwear;

a layer of shock-absorbing material positioned between the elastically deformable element and the outsole.

24. An article of footwear comprising:

an upper extending in a longitudinal direction between a heel zone and a forefoot zone and in a transverse direction between a medial side and a lateral side;

an outer bottom assembly positioned beneath the upper, the outer bottom assembly comprising:

an outsole;

an elastically deformable element having a substantially arch-shape in said transverse direction;

the elastically deformable element having an upper surface extending transversely and downwardly from an uppermost central portion at least to a position vertically beneath the medial side of the upper and at least to a position vertically beneath the lateral side of the upper, said upper surface of the elastically deformable element not extending upwardly vertically beneath either of the medial and lateral sides of the upper;

the elastically deformable element being located in a heel zone and/or in a forefoot zone of the article of footwear;

shock-absorbing material positioned between the elastically deformable element and the outsole;

a material forming an intermediate member positioned between the elastically deformable element and the upper, the intermediate member extending at least from the position vertically beneath the medial side of the upper to the position vertically beneath the lateral side of the upper.

25. An article of footwear according to claim 24, wherein:

said shock-absorbing material positioned between the elastically deformable element and the outsole comprises a foam having a hardness between 20 and 200 Asker C.

26. An article of footwear according to claim 24, wherein:

said material of said intermediate member comprises a foam having a hardness between 20 and 200 Asker C.

27. An article of footwear according to claim 24, wherein:

said elastically deformable element extends transversely from a medial edge to a lateral edge;

said elastically deformable element has an upwardly facing convex surface between said medial and lateral edges.

28. An article of footwear according to claim 27, wherein:

said elastically deformable element comprises a plurality of arms projecting outwardly from said medial edge and a plurality of arms projecting outwardly from said lateral edge.

* * * * *